United States Patent [19]

Calloway

[11] 4,449,711

[45] May 22, 1984

[54] BOARD GAME SIMULATING BUSINESS PRINCIPLES INVOLVING PETROLEUM COMMODITIES

[76] Inventor: Danny L. Calloway, 3814-6 Chamberlayne, Richmond, Va. 23227

[21] Appl. No.: 363,039

[22] Filed: Mar. 29, 1982

[51] Int. Cl.[3] ..... A63F 3/00

[52] U.S. Cl. ..... 273/256; 273/287

[58] Field of Search ..... 273/256, 287, 243, 357, 273/241, 355

[56] References Cited

U.S. PATENT DOCUMENTS

| | | | |
|---|---|---|---|
| 2,657,057 | 10/1953 | Chapin | 273/357 |
| 2,791,431 | 5/1957 | Scaroulis | 273/287 X |
| 3,305,236 | 2/1967 | Glass et al. | 273/357 |
| 3,352,558 | 11/1967 | Lucas | 273/287 X |
| 3,729,198 | 4/1973 | Shaffer | 273/243 |
| 3,801,104 | 4/1974 | Potts et al. | 273/287 X |
| 3,899,176 | 8/1975 | Gregan | 273/287 |
| 4,194,741 | 3/1980 | Rea | 273/243 |

FOREIGN PATENT DOCUMENTS

| | | | |
|---|---|---|---|
| 2055299 | 3/1981 | United Kingdom | 273/287 |

*Primary Examiner*—Richard C. Pinkham
*Assistant Examiner*—Scott Brown

[57] ABSTRACT

A game which can be played competitively by two, three or four persons, and which simulates financial activity in the acquisition and disposition of petroleum holdings, is comprised of a flat board containing at least one sequence of playing spaces and associated printed indicia, a depressed central region, a number selector, playing pieces adapted to be moved by a player a number of playing spaces dictated by the number selector, game pieces adapted to be placed upon the board, token money, and at least one set of cards containing indicia adapted to implement the playing of the game. The game also utilizes at least one spring-activated catapult, a cup in the depressed central region, and a ball to be thrown by the catapult into the cup.

1 Claim, 10 Drawing Figures

BOARD GAME SIMULATING BUSINESS PRINCIPLES INVOLVING PETROLEUM COMMODITIES

BACKGROUND OF THE INVENTION

This invention concerns a board game apparatus and is directed particularly to a game involving principles of business and economic speculation in the commodity of petroleum.

One object of this invention is to provide a game which simulates financial activity in the acquisition and disposition of petroleum holdings.

Another object of this invention is to provide a game of the aforesaid nature which can be played competitively by two, three or four persons.

A further object of the invention is to provide an easily understood, interesting and economically manufacturable board game of the aforesaid nature involving factors of chance and judgement in the playing thereof.

These objects and other objects and advantages of the invention will be apparent from the following description.

SUMMARY OF THE INVENTION

The above and other beneficial objects and advantages are accomplished in accordance with the present invention by a board game apparatus comprising:

(a) a rigid playing board of rectangular perimeter having printed indicia including playing spaces thereon and a depressed central region, (b) status pieces capable of standing upright upon the board and having the appearance of apparatus utilized for the recovery or processing of petroleum oil, (c) status signs capable of standing erect upon said board and containing indicia indicating nationalization status, (d) a first set of cards carrying indicia representing a business charter, (e) a second set of cards carrying indicia representing insurance policies, (f) a third set of cards carrying indicia representing bankruptcy status, (g) a multidenominational set of token money, (h) a pair of dice, and (i) playing pieces adapted to be moved by a player a number of spaces dictated by a throw of the dice.

In a preferred embodiment of the game, skill means are included which enable a player to secure playing advantage by skillful physical manipulation of said skill means.

BRIEF DESCRIPTION OF THE DRAWING

For a fuller understanding of the nature and objects of the invention, reference should be had to the following detailed description taken in connection with the accompanying drawing forming a part of this specification and in which similar numerals of reference indicate corresponding parts in all the figures of the drawing.

DESCRIPTION OF THE PREFERRED EMBODIMENT

Figure 1:
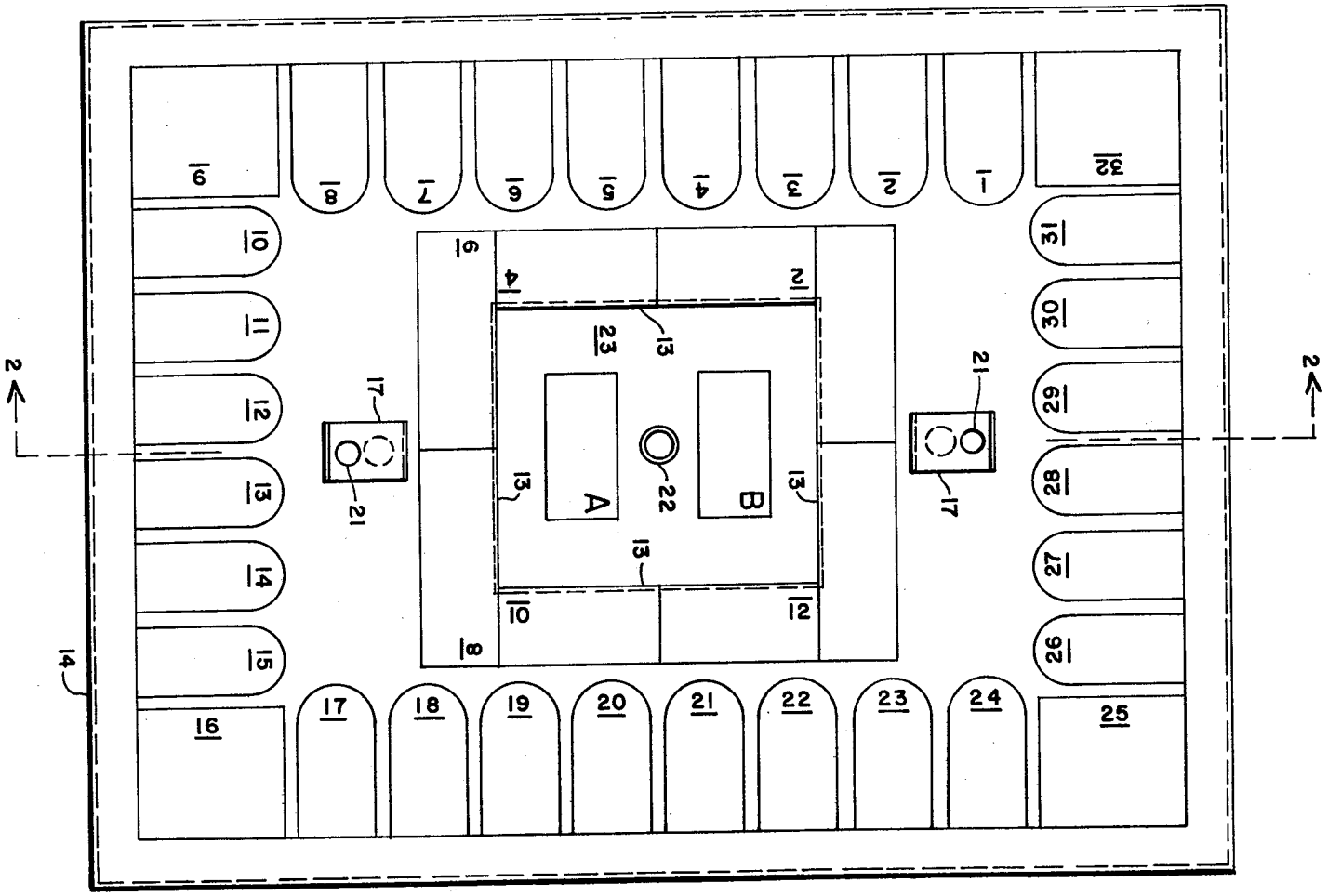
FIG. 1 is a top plan view of an embodiment of playing board of this invention.
Figure 2:
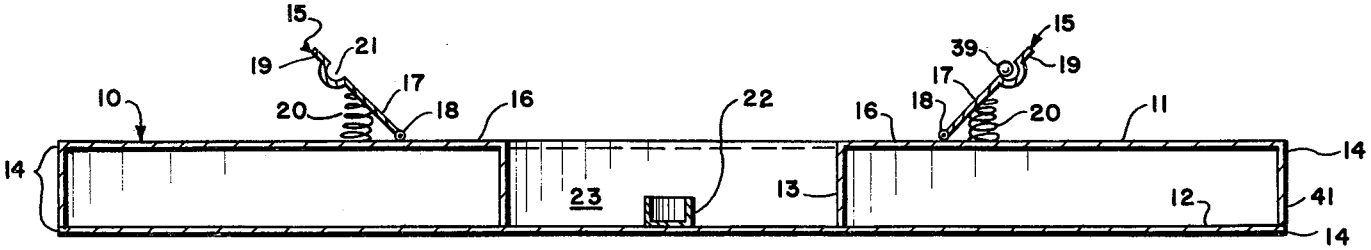
FIG. 2 is a sectional side view taken along the line 2—2 of FIG. 1.

Referring to FIGS. 1 and 2, a rigid playing board 10 for the game of this invention is shown comprised of apertured upper panel 11 and lower panel 12, both having identical outer perimeters 14 and held in vertically aligned juxtaposition by four vertical perimeter walls 41, and four interior vertical walls 13 which define a rectangular boxlike recess 23 centered in upper panel 11. The bottom of recess 23 is a portion of lower panel 12.

At least one catapult device 15 may be positioned atop the upper face 16 of upper panel 11. The catapult device is comprised of a rigid lever 17 joined by pivot means 18 to said upper panel and supported adjacent its distal extremity 19 by coil spring 20 extending between said lever and upper face 16. Adjacent said distal extremity is a depression 21 capable of seating a projectile object, preferably of spherical shape. A target cup 22 is centered in the bottom of said recess in line with the center longitudinal axis of lever 17. The lever, pivot means and spring are of such design and construction that manual depression and release of said lever is capable of throwing a projectile object such as ball 39 into cup 22.

Upper face 16 contains printed indicia comprising a series of 32 sequentially numbered outer playing spaces designated in FIG. 1 by underlined numerals, arranged in rectangular configuration, and comprised of four identical corner spaces of rectangular shape, and side spaces of identical arched appearance aligned between said corner spaces.

Lower panel 12 within recess 23 is provided with indicia comprising a series of sequentially numbered inner instruction spaces designated in FIG. 1 by overlined numerals, arranged in rectangular configuration and comprised of contiguous spaces of rectangular shape confining indicia describing various nationalization moves and instructions indicating which oil fields to nationalize. Within the rectangular array of instruction spaces on panel 12 are two rectangular spaces, designated A and B in FIG. 1, which contain indicia describing various business risks and instructions to pay or collect various amounts.

Further indicia of numerical, worded or pictorial nature may be confined within the aforementioned outer and inner spaces, said indicia constituting instructions for the playing of the game. Player-designating indicia may be located within outer margin 24 between outer perimeter 14 and the outer playing spaces.

Some of the outer playing spaces represent oil fields, and have means for selecting various numerical quantities signifying rates of oil productivity. One means for said selection of quantities comprises holes in the playing space associated with appropriate numerical indicia, and selector pegs adapted to stand upright in said holes. Four of said selector pegs would be utilized, one for each player.

Figure 3:
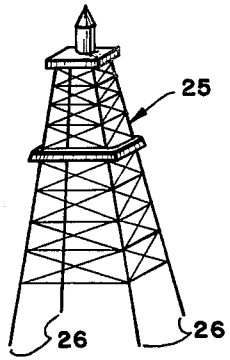
FIG. 3 is a front perspective view of an embodiment of status piece.

The status piece 25 shown in FIG. 3 is symbolic of a petroleum oil refinery. It is provided with four legs 26 which enable the status piece to be self-standing upon upper face 16. The span of legs 26 is such that the status piece can fit within any of the outer playing spaces. The height of the status pieces is between 1 and 3 inches. The game of this invention utilizes said status piece in four different sets of 12 to 25 each, each set differentiated by color or printed indicia.

Figure 4:
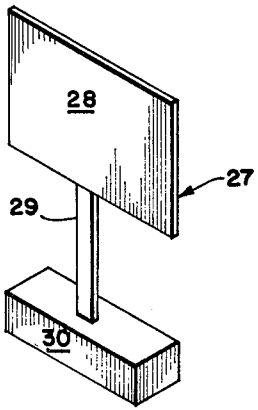
FIG. 4 is a front perspective view of an embodiment of status sign.

The status sign 27 shown in FIG. 4 is comprised of a sign panel 28, supporting post 29, and base 30 which enables the status sign to be self-standing upon upper fact 16. The size of the status sign is such that it can fit within any of the playing spaces. It is preferably of a height generally comparable to the height of the aforesaid playing pieces. The game of this invention utilizes between about 10 and 30 of said status signs. Both faces of sign panel 28 contain printed indicia representing instructions for the playing of the game.

Figure 5:
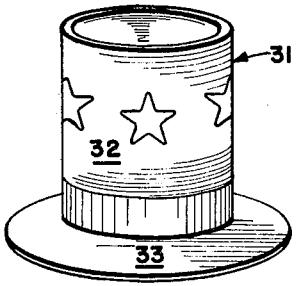
FIG. 5 is a perspective view of an embodiment of playing piece.

The playing piece 31 shown in FIG. 5 is symbolic of a hat comprised of a hollow cylindrical member 32 and a brim 22 outwardly flared from the open extremity of said cylindrical member. The playing piece is adapted to fit within the playing spaces. The game of this invention utilizes four of said playing pieces, each differentiated by color, shape, or printed indicia.

Figure 6:
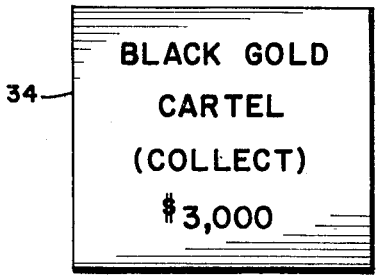
FIG. 6 is a plan view of an embodiment of a card of said first set.
Figure 7:
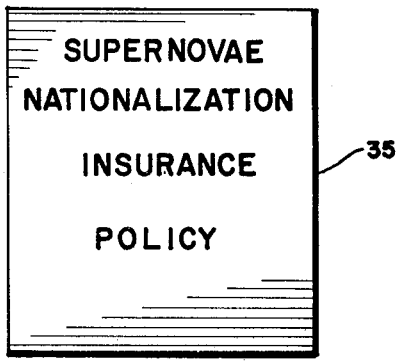
FIG. 7 is a plan view of an embodiment of a card of said second set.
Figure 8:
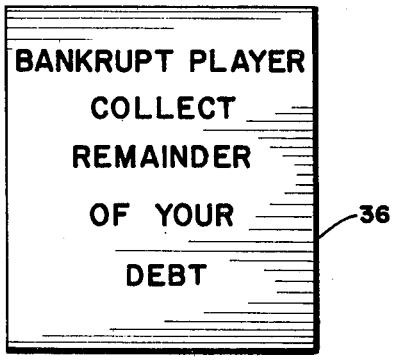
FIG. 8 is a plan view of an embodiment of a card of said third set.
Figure 9:
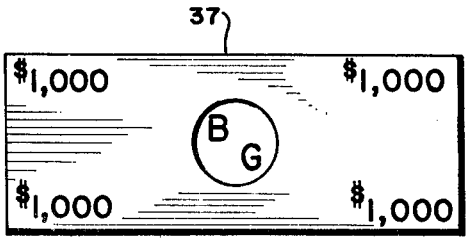
FIG. 9 is a plan view of an embodiment of token money.
Figure 10:
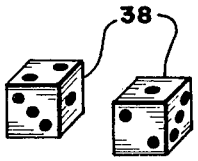
FIG. 10 is perspective view of an embodiment of said pair of dice.

Embodiments of cards 34, 35 and 36 of said first, second and third sets respectively are shown in FIGS. 6, 7 and 8 respectively. Each card is about 1½" square, carrying indicia on one or both faces representing instructional factors for the playing of the game. Each of said three sets is comprised of four cards. The indicia carried by the first set of cards represent various business charters such as cartel or monopoly status and oil productivity allowances. The indicia carried by the second set of cards concern various types and origins of insurance against government nationalization of oil reserves. The indicia carried by the third set of cards relate to bankruptcy factors.

In playing the game, each player must move his playing piece from the starting point in a counterclockwise direction. Said starting point may for example be the outer playing space designated 32 in FIG. 1. The number of playing spaces that a player moves his playing piece may be determined by a roll of the dice. As a playing piece comes to rest on a playing space, the player must exercise judgment in investing cash or choosing certain speculative economic courses of action. A skillful player who makes the right decisions and selects good investments will possess play money and thereby remain in the game. Other players will lose money. The last player possessing play money is the winner.

At the outset, each player rolls the dice. The player receiving the highest number plays first by moving his playing piece the rolled number of playing spaces. The lowest number is designated the banker. The banker handles all cash transactions and issues cards from each of said three sets. Each player begins with $15,000. Players may purchase nationalization insurance cards and/or bankruptcy avoidance cards before any player rolls the dice or moves his playing piece.

Some of the outer playing spaces are designated business risk points, and direct the player to roll the dice to determine whether he was successful in taking his business risk. Some of the outer playing spaces are designated government nationalization points, and direct the player to roll the dice to determine if he can nationalize one of another player's oil fields. At such space, the player plays twice. A player nationalizes an oil field by placing one of the government signs on the space, and collecting money. When a player stops on a space designated a government nationalization space, his first play is to roll his dice. If the sum of his dice is equal to a value that corresponds to an oil field that can be nationalized, he nationalizes that oil field. A player never nationalizes himself. The player's second play is to determine the next space that he will move to by utilizing the catapult or rolling the dice.

As a player stops on or passes the starting point, he receives from the banker an amount of money for each unnationalized oil field he owns. More money is received if the oil field has a cartel status. When a player stops on a space designated a business risk, he can choose between using the catapult or rolling the dice as his next playing move. If the player rolls the dice, he must roll an even number to be successful in his business deal. Then he collects money. Otherwise he is unsuccessful and pays money.

If the player uses the catapult, he must shoot the ball into the cup when he stops on an outer business risk space. If he shoots the ball in the cup he is successful in his business risk deal and collects money. Otherwise, he is unsuccessful, and pays money.

When a player's playing piece comes to rest on a playing space designating an oil field, he can invest by purchasing one or more refineries from the bank. When a player stops on his own oil field and purchases additional refineries for it, his rate of oil production is increased. When a player stops on an oil field owned by a competitor player, he must pay the owner refinery returns relative to the rate of oil production on said field.

Within each of the spaces designated an oil field is a schedule (list of values). These values range from "0000" to "11,000". If this schedule lies flat within the space, the player places a selector peg in a hole adjacent the value indicating the oil field's current rate of production and refinery returns. If said schedule lies on a cylinder device within the space, the player must turn the cylinder device so that its pointer points to a value indicating the oil field's current rate of production and refinery returns. Each time a new value is indicated on the schedule, the new value is greater than the previous value.

When a player cannot pay his debts, he may cash in his bankruptcy "save" card. If he does not have a save card he is bankrupt and out of the game. No selling of property can take place. When a player becomes bankrupt, his holdings become "government property" and are so indicated by signs 27. When another player stops on any government property, he has the option of purchasing the property at its nominal value or paying refinery returns to the government.

Only the property that the government acquires because a player becomes bankrupt is sold by the government. This property would have the government property for sale sign on it. Property that is placed under government control through the process of nationalization is not for sale. In such cases, the government nationalization sign is placed on the space representing the oil field.

In those emodiments utilizing catapult devices, the player may choose to utilize said catapult before or instead of rolling the dice, in which case the successful placement of ball 39 in cup 22 constitutes permission for the player to move his playing piece an optional number of up to twelve playing spaces.

When a player uses a catapult and shoots the ball into the cup, he can move to any playing space he chooses within a range of 12 spaces from the space he is presently on. If he misses, his move is determined by rolling the dice. If he is taking a business risk, then he collects cash based upon his status if he shoots the ball into the cup. If he misses, he pays cash based upon his status. The catapult is also used to enable a qualifying player to obtain a rate increase.

One embodiment of the game of this invention utilizes an Internal Revenue Service (IRS) provision. This includes regulation scales, IRS regulation cards, 1040 switches placed on starting points, coin-shaped gold pieces, the process of filing taxes, a battery operated buzzer or whistle device, and the use of player's charters.

While particular examples of the present invention have been shown and described, it is apparent that changes and modifications may be made therein without departing from the invention in its broadest aspects. The aim of the appended claims, therefore, is to cover all such changes and modifications as fall within the true spirit and scope of the invention.

Having thus described my invention, what is claimed is:

1. A board game apparatus comprising:

(a) a rigid playing board of rectangular perimeter having an upper playing face and printed indicia thereon, and a depressed central region having a lower playing face and indicia thereon, (b) status signs capable of standing upright upon said board and containing indicia denoting nationalization status, (c) a first set of cards carrying indicia representing a business charter, (d) a second set of cards carrying indicia representing insurance matters, (e) a multidenominational set of token money, (f) number-selecting means, (g) playing pieces adapted to be moved by a player a number of playing spaces dictated by said number-selecting means, (h) at least one spring activated catapult device mounted upon said playing board, (i) a ball adapted to be thrown by said catapult device, and (j) a cup centered in said depressed central region and adapted to catch said ball.

* * * * *